US010385661B2

(12) United States Patent
Kang

(10) Patent No.: US 10,385,661 B2
(45) Date of Patent: Aug. 20, 2019

(54) SACRIFICIAL SCREEN SHROUD

(71) Applicant: HALLIBURTON ENERGY SERVICES, INC., Houston, TX (US)

(72) Inventor: James Jun Kang, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 327 days.

(21) Appl. No.: 15/304,360

(22) PCT Filed: Jun. 17, 2014

(86) PCT No.: PCT/US2014/042762
§ 371 (c)(1),
(2) Date: Oct. 14, 2016

(87) PCT Pub. No.: WO2015/195099
PCT Pub. Date: Dec. 23, 2015

(65) Prior Publication Data
US 2017/0044879 A1 Feb. 16, 2017

(51) Int. Cl.
*E21B 43/08* (2006.01)
*E21B 47/00* (2012.01)

(52) U.S. Cl.
CPC ..... *E21B 43/086* (2013.01); *E21B 43/08* (2013.01); *E21B 43/084* (2013.01); *E21B 43/088* (2013.01); *E21B 47/00* (2013.01)

(58) Field of Classification Search
CPC ..... E21B 43/08; E21B 43/084; E21B 43/086; E21B 43/088; E21B 47/00
See application file for complete search history.

(56) References Cited

U.S. PATENT DOCUMENTS

| | | | | |
|---|---|---|---|---|
| 6,857,476 | B2 * | 2/2005 | Richards | E21B 43/04 166/227 |
| 2004/0134656 | A1 | 7/2004 | Richards | |
| 2005/0155772 | A1 | 7/2005 | Dusterhoft et al. | |
| 2008/0035330 | A1 | 2/2008 | Richards | |
| 2009/0126950 | A1 | 5/2009 | Moen | |
| 2016/0222767 | A1 * | 8/2016 | Sladic | E21B 43/086 |
| 2016/0273320 | A1 * | 9/2016 | Greci | E21B 43/088 |
| 2016/0326849 | A1 * | 11/2016 | Bruce | E21B 43/08 |
| 2016/0376876 | A1 * | 12/2016 | Provost | E21B 43/08 166/278 |
| 2017/0044879 | A1 * | 2/2017 | Kang | E21B 43/08 |
| 2017/0362919 | A1 * | 12/2017 | Lazo | E21B 43/08 |

FOREIGN PATENT DOCUMENTS

| | | | | |
|---|---|---|---|---|
| EP | 0431162 | A1 * | 6/1991 | E21B 34/06 |
| EP | 0955447 | A2 * | 11/1999 | B01D 29/15 |
| EP | 2245265 | B1 | 12/2013 | |

OTHER PUBLICATIONS

International Search Report and Written Opinion issued by the Korean Intellectual Property Office regarding International Application No. PCT/US2014/042762, 13 pages.

* cited by examiner

*Primary Examiner* — Daniel P Stephenson
(74) *Attorney, Agent, or Firm* — Haynes and Boone, LLP

(57) ABSTRACT

A method and apparatus including a screen assembly that includes a screen having a plurality of openings and a sacrificial shroud disposed over a portion of the openings and disposed to erode under flow of formation fluid through the screen. The shroud is configured to erode more quickly than the screen over which it is disposed, thereby altering the erosion zone of the screen over time and prolonging the life of the screen.

20 Claims, 7 Drawing Sheets

SACRIFICIAL SCREEN SHROUD

TECHNICAL FIELD

The present disclosure relates generally to well completion and production operations and, more specifically, to extending the life of a fluid screen using a sacrificial screen shroud.

BACKGROUND

In the process of completing an oil or gas well, a tubular is run downhole and used to communicate produced hydrocarbon fluids from the formation to the surface. Typically, this tubular is coupled to a screen assembly that controls and limits debris, such as gravel, sand, and other particulate matter, from entering the tubular as the fluid passes through the screen assembly.

The screen assembly includes a filter in the form of a screen which screen has multiple entry points at which the produced fluid (liquid and/or gas) passes through the screen. The screen is generally cylindrical and is positioned adjacent or in proximity to an inflow control device (ICD), which ICD regulates the flow of the produced fluid after the produced fluid passes through an entry point of the screen. The screen has a length, and the velocity at which the produced fluid passes through the screen varies along the length of the screen. That is, the velocity increases as the entry point of the produced fluid nears the ICD. Because the velocity of the produced fluid passing through the screen is highest at a portion of the screen that is closest to the ICD, erosion at this portion of the screen is accelerated compared to portions of the screen located farther away from the ICD. Generally, the portion of the screen that is closest to the ICD erodes more quickly than other portions of the screen, and thus is most likely to fail first.

The present disclosure is directed to a sacrificial screen shroud and methods that overcome one or more of the shortcomings in the prior art.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Figure 1:
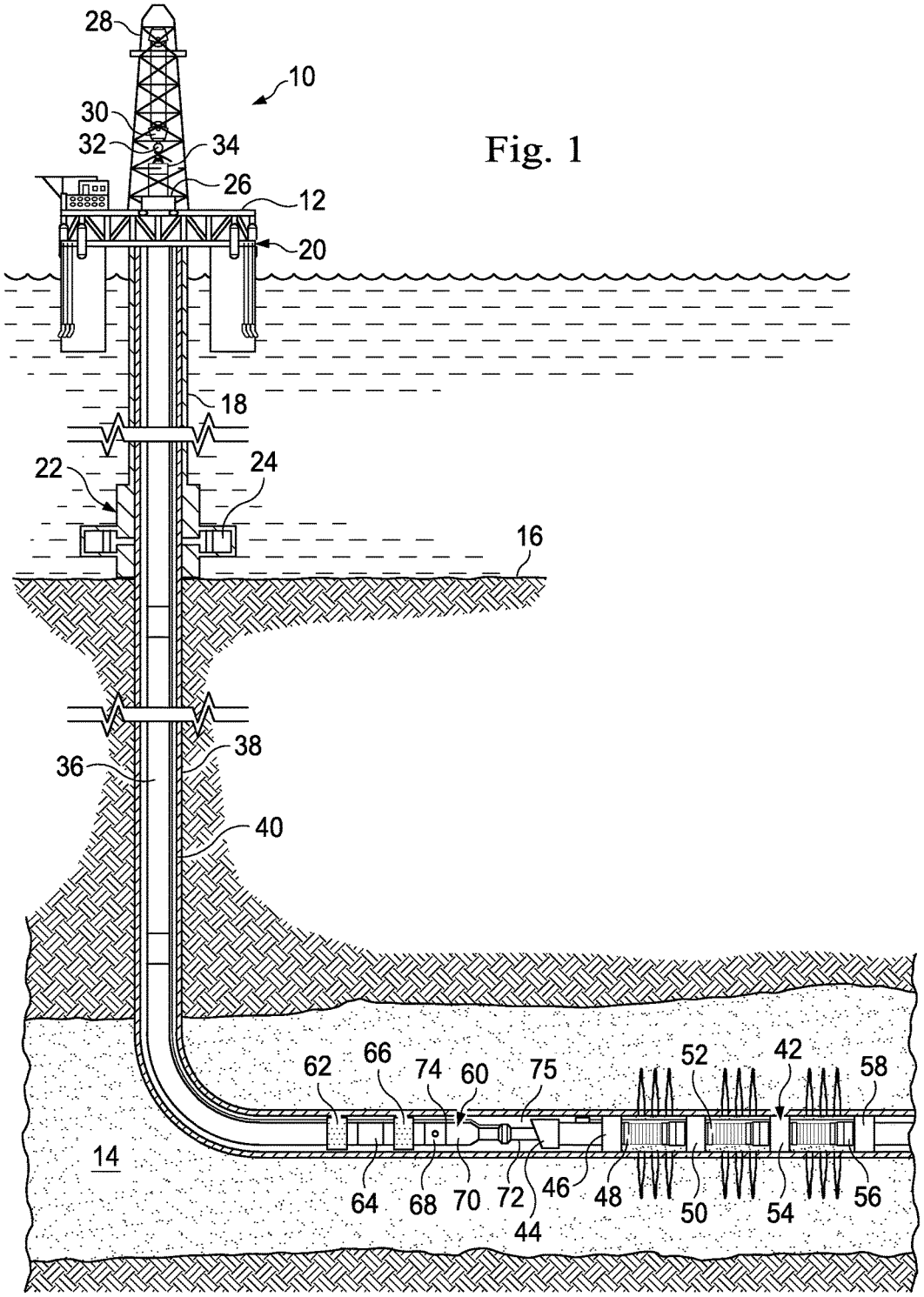
FIG. 1 is a schematic illustration of an offshore oil and gas platform operably coupled to a flow regulating system according to an embodiment of the present disclosure.

Illustrative embodiments and related methods of the present disclosure are described below as they might be employed in a sacrificial screen shroud and method of operating the same. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" may encompass both an orientation of above and below. The apparatus may be otherwise oriented (rotated 90 degrees or at other orientations) and the spatially relative descriptors used herein may likewise be interpreted accordingly.

Referring initially to FIG. 1, an upper completion assembly is installed in a well having a lower completion assembly disposed therein from an offshore oil or gas platform that is schematically illustrated and generally designated 10. A semi-submersible platform 12 is positioned over a submerged oil and gas formation 14 located below a sea floor 16. A subsea conduit 18 extends from a deck 20 of the platform 12 to a subsea wellhead installation 22, including blowout preventers 24. The platform 12 has a hoisting apparatus 26, a derrick 28, a travel block 30, a hook 32, and a swivel 34 for raising and lowering pipe strings, such as a substantially tubular, axially extending tubing string 36.

A wellbore 38 extends through the various earth strata including the formation 14 and has a casing string 40 cemented therein. Disposed in a substantially horizontal portion of the wellbore 38 is a lower completion assembly 42 that includes at least one flow regulating system, such as flow regulating system 48 or flow regulating system 52 or 56, and may include various other components, such as a latch subassembly 44, a packer 46, a packer 50, a packer 54, and a packer 58.

Disposed in the wellbore 38 at the lower end of the tubing string 36 is an upper completion assembly 60 that may include various components such as a packer 62, an expansion joint 64, a packer 66, a fluid flow control module 68, and an anchor assembly 70. The upper completion assembly 64 may also include a latch subassembly 72. One or more communication cables such as an electric cable 74 that passes through the packers 62, 66 may be provided and extend from the upper completion assembly 60 to the surface in an annulus 75 between the tubing string 36 and the casing 40. The latch subassembly 42 couples to the latch subassembly 72.

Even though FIG. 1 depicts a horizontal wellbore, it should be understood by those skilled in the art that the apparatus according to the present disclosure is equally well suited for use in wellbores having other orientations including vertical wellbores, slanted wellbores, multilateral wellbores or the like. Accordingly, it should be understood by those skilled in the art that the use of directional terms such as "above," "below," "upper," "lower," "upward," "downward," "uphole," "downhole" and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIG. 1 depicts an offshore operation, it should be understood by those skilled in the art that the apparatus according to the present disclosure is equally well suited for use in onshore operations. Further, even though FIG. 1 depicts a cased hole completion, it should be understood by those skilled in the art that the apparatus according to the present disclosure is equally well suited for use in open hole completions.

Figure 2:
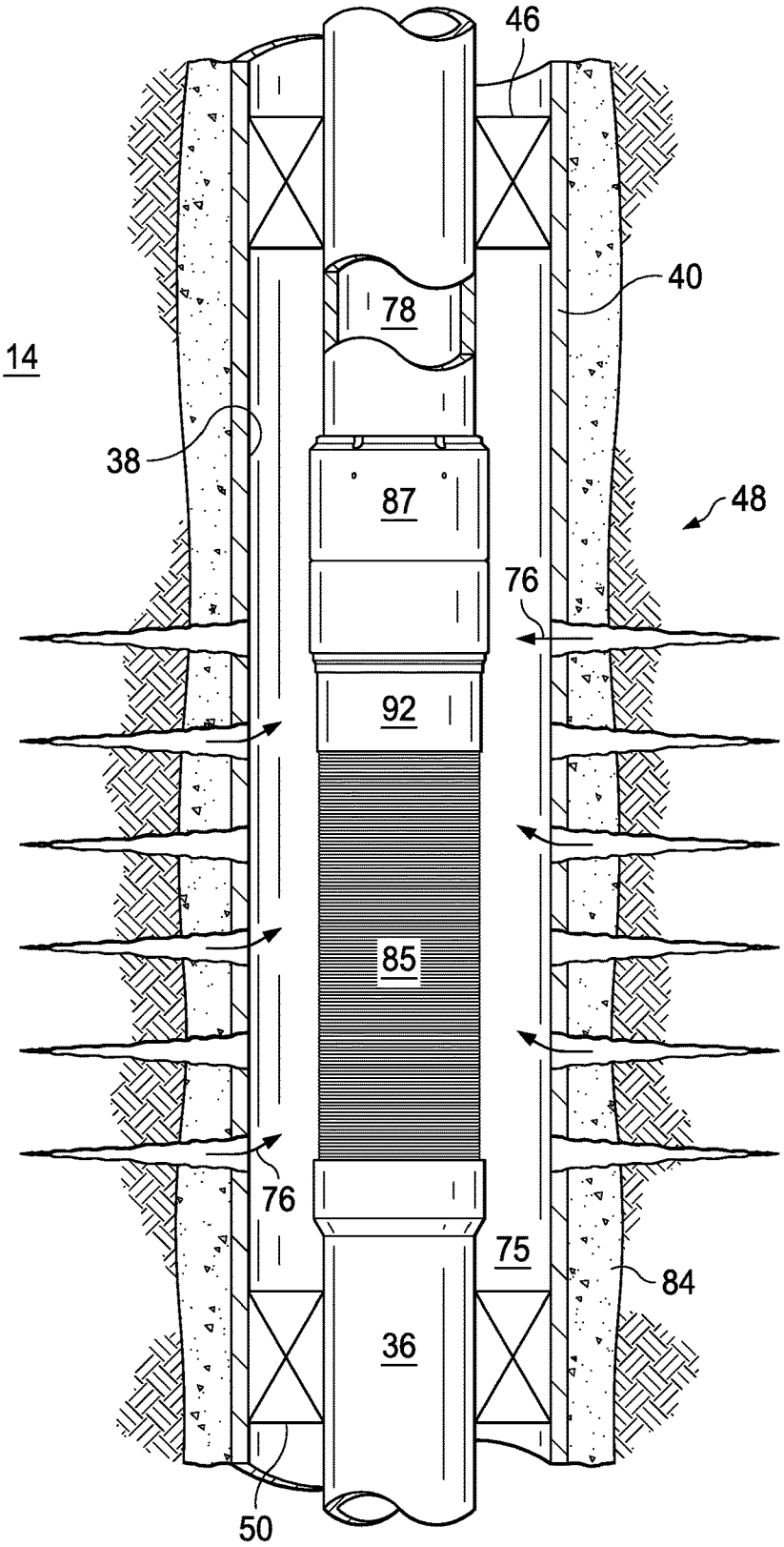
FIG. 2 illustrates a side view of the flow regulating system of FIG. 1, according to an exemplary embodiment of the present disclosure.

FIG. 2 illustrates the flow regulating system 48 according to an exemplary embodiment. The flow regulating system 48 restricts flow of a fluid 76 from the formation 14 to an interior flow passage 78 of the tubular string 36 (such as a production tubing string, liner string, etc.). As shown, the annulus 75 is formed radially between the tubular string 36 and the wellbore 38 lined with the casing string 40 and cement 84. The fluid 76 flows from the formation 14 into the annulus 75 through the flow regulating system 48. The flow regulating system 48 generally includes a screen 85 and an inflow control device ("ICD") 87. The screen 85 prevents or at least reduces the amount of debris, such as gravel, sand, and other particulate matter, from entering the interior flow passage 78. In one or more embodiments, the fluid 76 passing through the screen 85 then flows through the ICD 87 and into the interior flow passage 78 for eventual production to the surface, while in other embodiments, the fluid 76 passing through the screen 85 may flow along a defined flow path directly to the interior flow passage 78.

Figure 3:
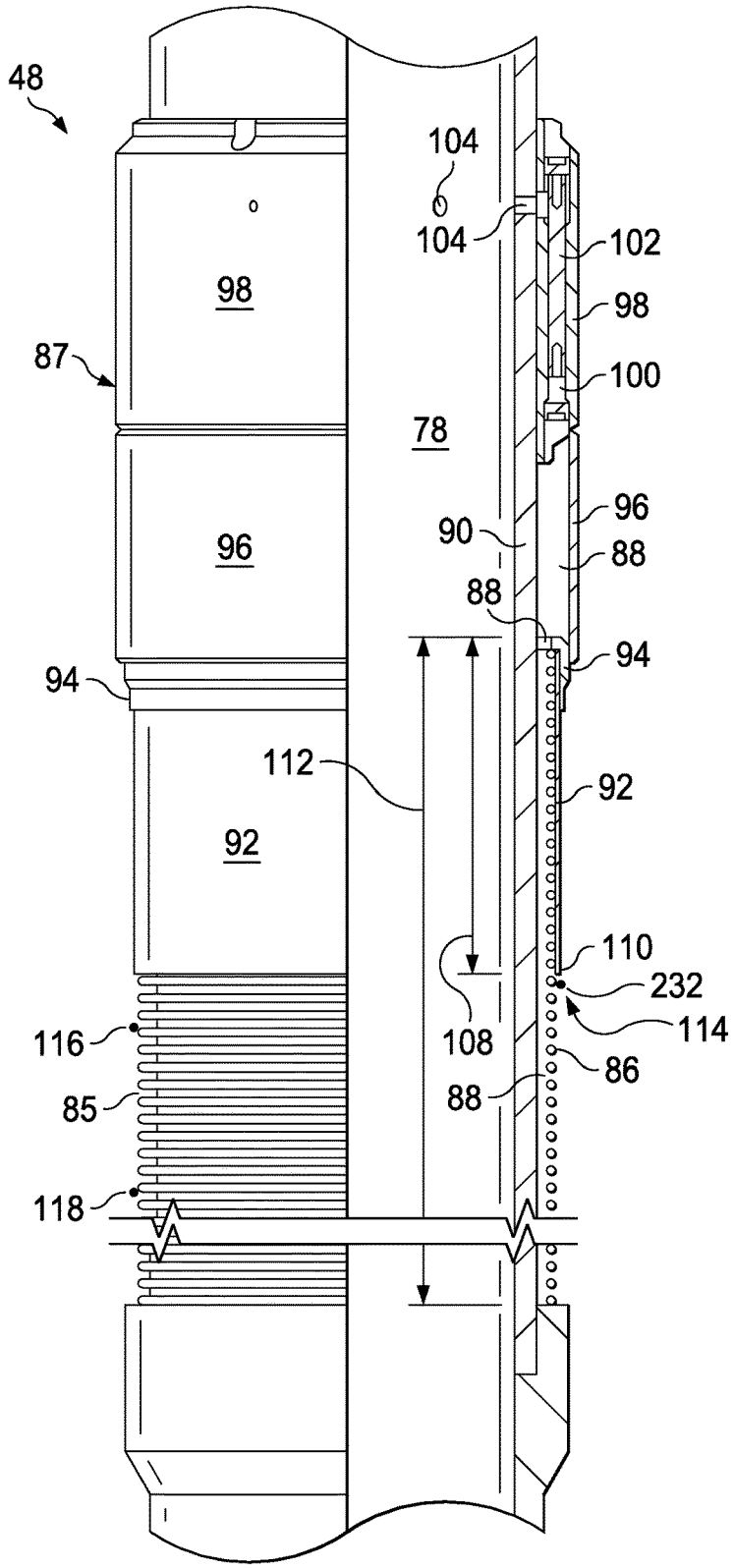
FIG. 3 illustrates a partial sectional view of the flow regulating system of FIG. 2, according to an exemplary embodiment of the present disclosure.

FIG. 3 illustrates a more detailed view of the flow regulating system 48 according to an exemplary embodiment. In one or more embodiments, the screen 85 of the flow regulating system 48 is a filter formed of wire 86 and disposed on an inner tubular member or base pipe 90. In one or more embodiments, the base pipe 90 is an elongated tubular member. Preferably, the wire 86 is wound or wrapped onto the base pipe 90 to form the screen 85. In other embodiments, screen 85 may be a wire or synthetic mesh. In one or more embodiments, the screen 85 is an elongated tubular member and is disposed on the base pipe 90 so as define an exterior flow path or passage 88 between the screen 85 and the base pipe 90. In one or more embodiments, gaps between the wires 86 form openings, or entry points 91, through which the fluid 76 passes through the screen 85. The passage 88 may be defined utilizing standoff supports (not shown) arranged in parallel, and circumferentially spaced around the exterior surface of the base pipe 90 to support the screen 85 in a spaced apart arrangement from the base pipe 90. The passage 88 may also be defined between one or more adjacent screens 85 laid over one another or may be defined by the screen 85 itself. In any event, the passage 88 is formed to direct flow towards the interior flow passage 78, which is defined within the base pipe 90. In one or more embodiments where the ICD 87 is included, the flow regulating system 48 further includes a shroud 92 disposed about the exterior surface of the screen 85 so that a portion of the screen 85 is covered by the shroud 92. An interface ring 94 is disposed about the exterior surface of the shroud 92 to secure the shroud 92 and the screen 85 to the base pipe 90. In one or more embodiments, the interface ring 94 may be secured using a "shrink fit" to secure the shroud 92 and the screen 85 to the base pipe 90. However, the shroud 92 may be attached to the base pipe 90 in a variety of ways, such as for example, using a friction fit, a threaded connection, a nut and a bolt, a weld, etc. A sleeve 96 is disposed in proximity to and/or about the exterior surface of the base pipe 90 defines a portion of the passage 88. In some embodiments, the sleeve 96 is supported by the interface ring 94. The ICD 87 is disposed adjacent or in proximity to the screen 85 along the base pipe 90, preferably concentrically disposed about the exterior surface of the base pipe 90. In an exemplary embodiment, the ICD 87 is configured to be coupled to the sleeve 96. In an exemplary embodiment, the ICD 87 includes one or more tubular structures 100, which restrict the flow of the fluid 76 from the passage 88 to an annular chamber 102 of ICD 87. Although only one of the tubular structures 100 is visible in FIG. 3, a series of the tubular structures 100 may be arranged in parallel, and circumferentially spaced apart within the ICD 87. The tubular structures 100 are one example of flow restrictors which may be used in the ICD 87. In an exemplary embodiment, other types of flow restrictors may be used, such as for example chokes, orifices, nozzles, etc. Any type of flow restrictor may be used in keeping with the scope of this disclosure. In an exemplary embodiment, the fluid 76 flows through the tubular structures 100 to the annular chamber 102. Thus, the tubular structures 100 provide for parallel flow of the fluid 76 from the passage 88 to the annular chamber 102. The fluid 76 flows from the chamber 102 and then inward via openings 104 in the base pipe 90 to the interior flow passage 78. The openings 104 are formed radially through the base pipe 90, which is configured (e.g., with threads at either end, etc.) for interconnection in the tubular string 36. Persons of skill in the art will appreciate that while ICD 87 is described in some embodiments, in other embodiments, an ICD 87 need not be included. For example, the base pipe 90 may be provided with the openings 104. The screen 85 having the shroud 92 overlays the base pipe 90. The screen 85 is longitudinally spaced apart from the openings 104 so the passage 88 extends longitudinally between the openings 91 of the screen 85 and the openings 104 to guide the fluid 76 flowing through the screen 85 to the openings 104.

Although the shroud 92 may have any shape or coverage of the screen 85, in one or more exemplary embodiments, the shroud 92 is a generally cylindrical tubular forming an interior surface that contacts the exterior surface of the screen 85. In one or more exemplary embodiments, the shroud 92 extends over the exterior surface of the screen 85 to define an initially covered portion of the screen 85. In one or more exemplary embodiments, the shroud 92 blocks a portion of the entry points 91 of the screen 85 to prevent or limit the amount of the fluid 76 that passes through the entry points 91 within the initially covered portion of the screen 85. In one or more exemplary embodiments, the shroud 92 is composed of a metal. However, the shroud 92 may be composed of any metallic or non-metallic material and any combination thereof. In an exemplary embodiment, the shroud 92 may be composed of any type of material that erodes quicker than the screen 85 when exposed to similar conditions. That is, the shroud 92 may be composed of a material having a higher expected rate of erosion than the material of which the screen 85 is composed. In one or more exemplary embodiments, the hardness of the shroud 92 may be less than the hardness of the screen 85, where the hardness is quantified by a Vickers Pyramid Number, a Diamond Pyramid Hardness, or a Brinell hardness number, or measured by the Rockwell test or the Meyer hardness test. In an exemplary embodiment, the screen 85 is composed of a metal. However, the screen 85 may be composed of any metallic or non-metallic material and any combination thereof. The screen 85 may be composed of any type of material that erodes slower than the shroud 92. That is, the shroud 92 may be composed of any type of materials that has a higher expected rate of erosion than the screen 85. In an exemplary embodiment, the expected rate of erosion depends on the expected conditions downhole.

In an uneroded state, the shroud 92 extends by a length 108 over a first portion of the screen 85. The shroud 92 has a thickness and a distal end 110 that defines the length 108 of the shroud 92. The distal end 110 of the shroud is spaced apart from the openings 104 or the ICD 87, as the case may be. The screen 85 has a length 112 which is longer than length 108. The velocity of the fluid 76 that enters the screen 85 depends upon the location of its entry point 91 along the screen length 112. At any given point in time, the velocity of the fluid 76 passing through the screen 85 will be highest at those entry points 91 along the screen 85 that are closest to the openings 104 or the ICD 87 (as the case may be), and will be lowest at those entry points 91 that are farthest from the openings 104 or the ICD 87. Thus, the exterior surface of the screen 85 that is exposed to the wellbore 38, i.e., the exposed portion of the screen 85, and that is adjacent the shroud distal end 110 is a high velocity area, or an erosion hotspot 114. In one or more embodiments, the erosion hotspot 114 is an area on the screen 85 in which the fluid 76 enters the entry points 91 at a velocity that is greater than any other area on the screen 85. In one or more embodiments, the location of the erosion hotspot 114 is dependent upon the location of the shroud distal end 110. Accordingly, as the location of the shroud distal end 110 changes, the location of the erosion hotspot 114 also changes. The velocity of the fluid 76 as it enters the screen 85 decreases as the distance between the entry point 91 of the fluid 76 and the distal end 110 increases. That is, the velocity of the fluid 76 that enters the screen 85 at a point 116 is higher than at a point 118. The rate of erosion of the wires in the screen 85 correlate to the velocity of the fluid 76 as it enters the screen 85. Therefore, the erosion hotspot 114 will have an erosion rate higher than an area associated with the point 116 and an area associated with the point 118. As the distal end 110 defines the erosion hotspot 114, the shroud end 110 will also be subject to the fluid 76 passing at a high velocity. Due to the material of the shroud 92, the erosion rate of the shroud 92 is higher than that of the screen 85. Therefore, under the flow of fluid 76, the distal end 110 of shroud 92 will erode faster than the screen 85 located within the erosion hotspot 114 and adjacent the distal end 110 of the shroud 92.

Figure 4:
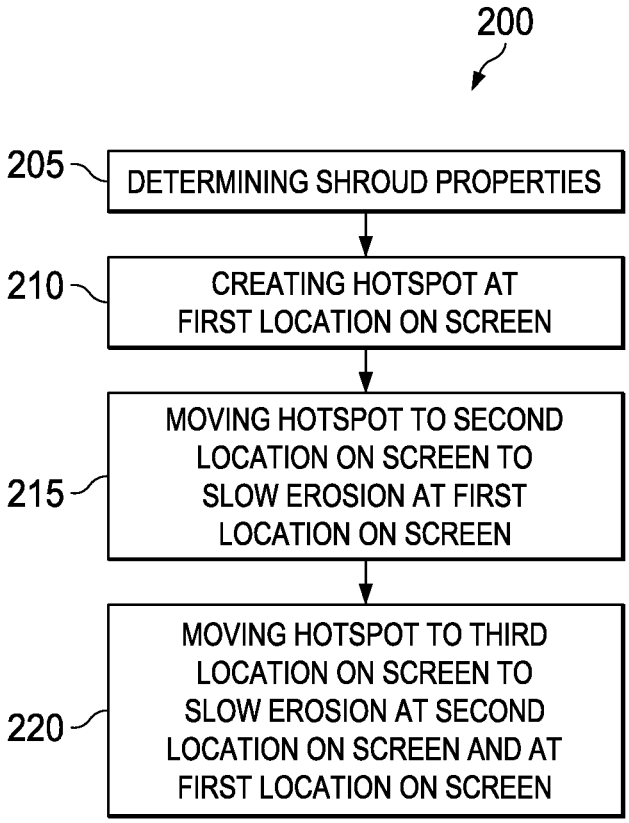
FIG. 4 is a flow chart illustration of a method of operating the apparatus of FIG. 2, according to an exemplary embodiment of the present disclosure.

In an exemplary embodiment and as illustrated in FIG. 4 with continuing reference to FIGS. 1-3, a method 200 of operating the apparatus 48 includes determining shroud properties at step 205, creating the erosion hotspot 114 at a first location on the screen 85 at step 210, moving the erosion hotspot 114 to a second location on the screen 85 to slow erosion at the first location on the screen 85 at step 215, and moving the erosion hotspot 114 to a third location on the screen 85 to slow erosion at the second location and at the first location on the screen at step 220.

At the step 205, the shroud properties are determined. In one or more embodiments, determining shroud properties may include selecting a shroud material that has a greater erosion rate than the material forming the screen 85 with which the shroud 92 is to be used. The shroud properties may include any one of the shroud length 108, the material of the shroud 92, and the thickness of the shroud 92, the structure of the shroud 92, etc. In one or more embodiments, determining the shroud properties may be dependent upon any one of the expected well life, the expected velocity of the fluid 76, the material of the screen 85, the length of the screen 85, a screen type, the expected temperatures downhole, the material within the formation 14, the fluid 76 or gas, etc. In one or more embodiments, the shroud length 108 is a function of the screen length 112.

The erosion hotspot 114 is created at a first location on the screen 85 at the step 210 by selecting a particular length 108 of the shroud 92 and positioning the shroud 92 relative to the screen 85 to block a portion of the entry points 91, and thereafter, allowing the fluid 76 to flow from the formation 14 and into the interior flow passage 78 to create the erosion hotspot 114 at the first location. It will be appreciated that allowing the fluid 76 to flow may include opening or otherwise adjusting the ICD 87 or other valves to permit fluid 76 to flow through the openings 104 into the interior flow passage 78. In an exemplary embodiment and as illustrated in FIG. 3, the first location encompasses a point 232 on the screen 85. In an exemplary embodiment, the point 232 is adjacent the shroud distal end 110.

Figure 5:
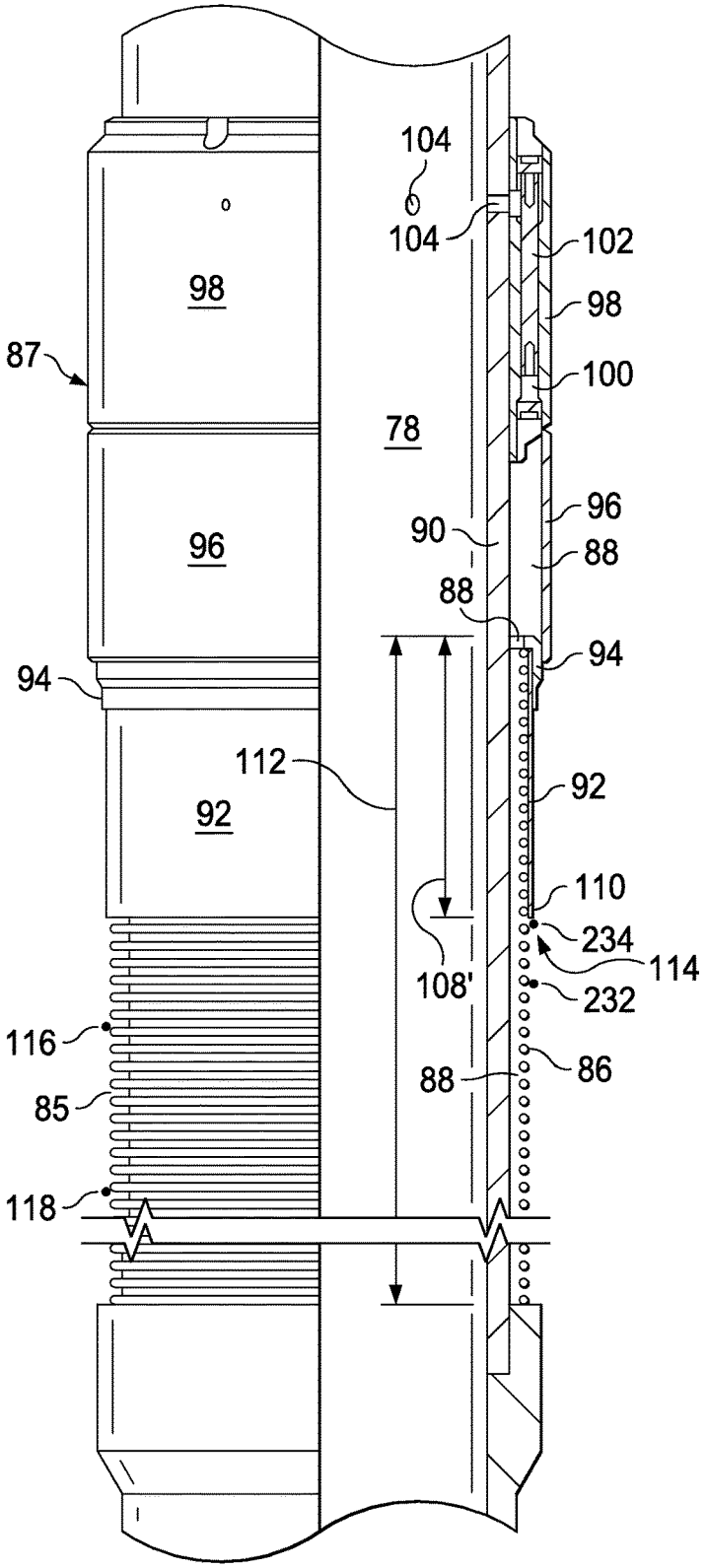
FIG. 5 illustrates a partial sectional view of the flow regulating system of FIG. 2 during the execution of a step of the method of FIG. 4, according to an exemplary embodiment of the present disclosure.

In an exemplary embodiment and as illustrated in FIG. 5, the erosion hotspot 114 is moved to a second location on the screen 85 to slow erosion at the first location on the screen 85 at the step 215. In a first eroded state, the distal end 110 has been eroded, decreasing the original length 108 such that the shroud 92 has a length of 108'. Because the erosion hotspot 114 is adjacent to the shroud distal end 110, the erosion hotspot 114 has also moved closer to the ICD 87 (or openings 104). That is, the erosion hotspot 114 no longer encompasses point 232. Instead, the erosion hotspot 114 encompasses a point 234. In one or more embodiments, in order to move the erosion hot spot 114, the flow rate of the fluid 76 passing into the interior flow passage 78 may be adjusted by opening or otherwise adjusting the ICD 87 or other valves. For example, the flow rate may be temporarily increased by opening a valve to increase the velocity of fluid passing over distal end 110, thus increasing the erosion rate of the shroud 92 until the distal end 110 has changed to a new location relative to the screen 85. Subsequently, the flow rate may be decreased, such as back to a normal range for production. During the first eroded state, the initially covered portion of the screen 85 has decreased in size and the exposed portion of the screen 85 has increased in size. Due to erosion of the shroud 92 (resulting in the length of the shroud 92 decreasing), the rate of erosion associated with the first location in step 210 is less than the rate of erosion associated with the second location in the step 215.

Figure 6:
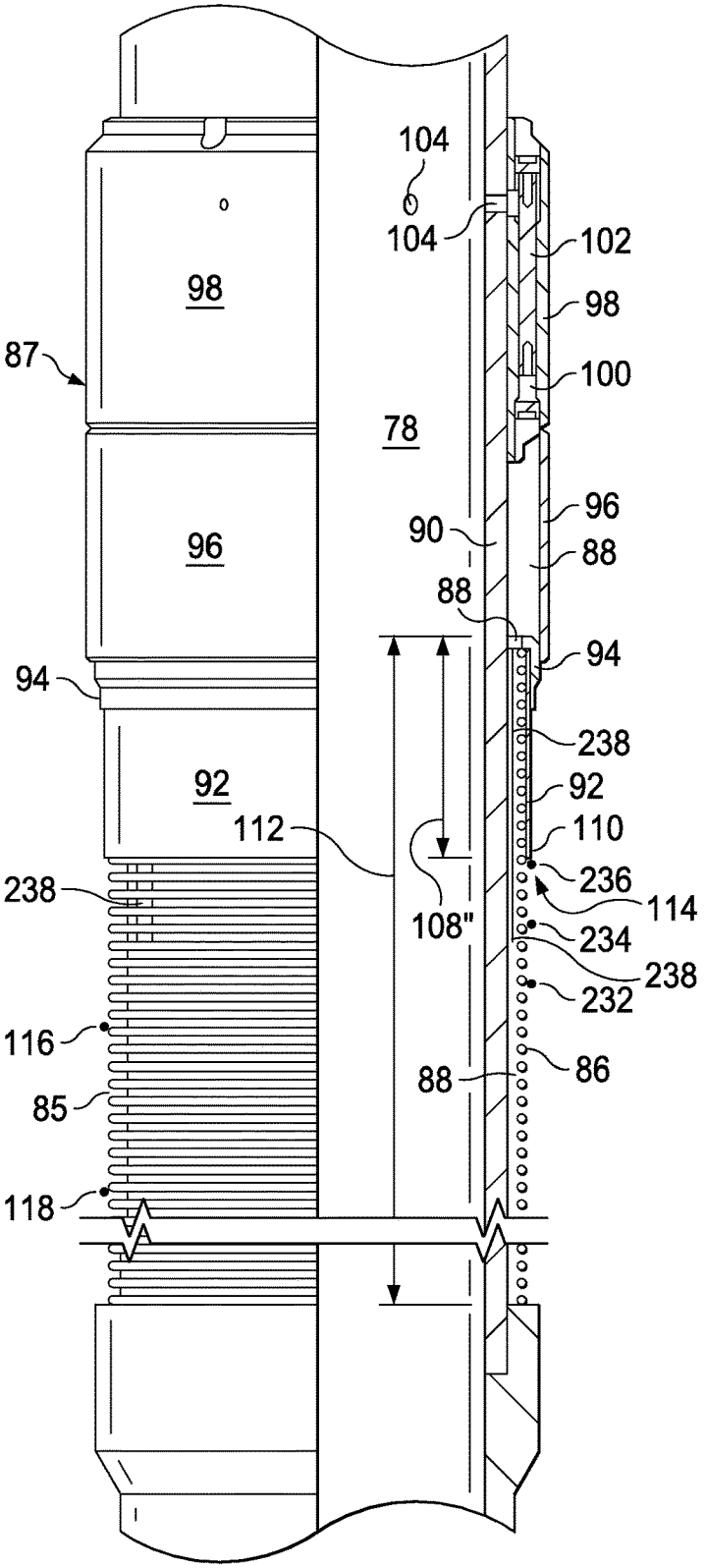
FIG. 6 illustrates a partial sectional view of the flow regulating system of FIG. 2 during the execution of another step of the method of FIG. 4, according to an exemplary embodiment of the present disclosure.

With ongoing reference to FIG. 4 and as illustrated in FIG. 6, in step 220, the high velocity area is moved to a third location to slow erosion at the second location and the first location on the screen 85. In a second eroded state, the distal end 110 has been eroded such that the shroud 92 has a length of 108". Because the erosion hotspot 114 is adjacent to the shroud distal end 110, the erosion hotspot 114 has also moved closer to the ICD 87 (or openings 104). That is, the erosion hotspot 114 no longer encompasses point 234. Instead, the erosion hotspot 114 encompasses a point 236. Because the erosion hotspot 114 is adjacent to the shroud distal end 110, the erosion hotspot 114 has also moved closer to the ICD 87 (or openings 104). In the second eroded state, the initially covered portion of the screen 85 has decreased in size and the exposed portion of the screen 85 has increased in size. Because the erosion hotspot 114 has moved closer to the ICD 87 (or openings 104), the rate of erosion associated with the second location and the first location is slowed. In one or more embodiments, in order to move the erosion hot spot 114 in step 220, the flow rate of the fluid 76 passing into the interior flow passage 78 may be adjusted by opening or otherwise adjusting the ICD 87 or other valves. For example, the flow rate may be temporarily increased by opening a valve to increase the velocity of fluid passing over the distal end 110, thus increasing the erosion rate of the shroud 92 until the distal end 110 has changed to a new location relative to the screen 85. Subsequently, the flow rate may be decreased, such as back to a normal range for production.

In one or more embodiments, the shroud 92 is a sacrificial shroud that erodes faster than the wire 86 of the screen 85 adjacent the shroud 92 so as to slowly expose the initially covered portion of the screen 85. The erosion of the sacrificial shroud 92 moves the erosion hotspot 114 over time to distribute the erosion hotspot 114 and the corresponding high erosion rate over a length of the screen 85. In one or more embodiments, the method 200 may be used to dynamically move the erosion hotspot 114 to resist or delay an area of the screen 85 from eroding to the point of failure. Failure of the screen 85 is associated with a portion of the wires 86 being eroded to such a degree that debris is allowed to enter the passage 88 In one or more exemplary embodiments, erosion of the screen 85 may be monitored at a particular point and the erosion hot spot 114 may be moved once erosion at the monitored point reaches a predetermined threshold. In one or more embodiments, erosion sensors 238 (one shown in FIG. 6) may be deployed to monitor the erosion of the screen 85. Once erosion at a particular sensor reaches a predetermined threshold, the flow may be adjusted as described above, to cause the hot spot 114 to move to another location, after which, the flow may be adjusted back to normal production rates as desired. In one or more embodiments, erosion of the screen 85 is associated with a region of the screen 85 no longer maintaining sufficient control of the debris. Thus, fluid 76 may be monitored, in any known method, to identify an increase in debris passing through the screen 85. Once the debris reaches a particular threshold, the erosion hotspot 114 may be moved as described above. In one or more embodiments, the method 200 may be used to slowly expose the initially covered portion of the screen 85 to the erosion hotspot 114.

Figure 7:
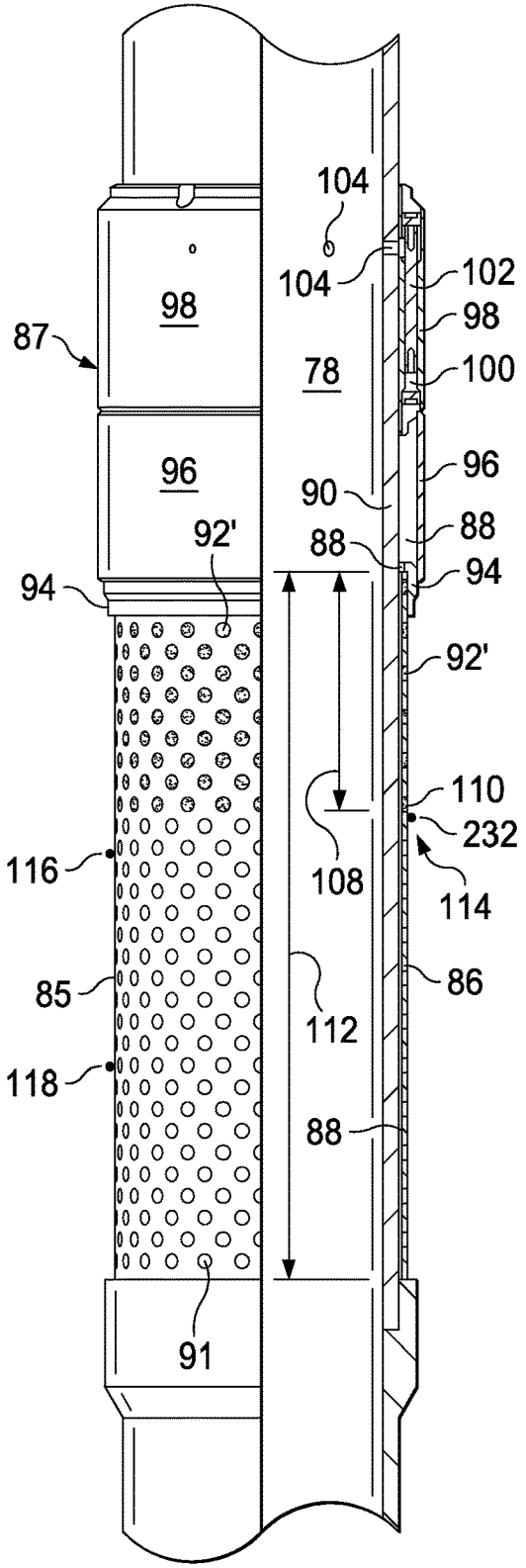
FIG. 7 illustrates a partial sectional view of the flow regulating system of FIG. 2, according to another exemplary embodiment of the present disclosure.

Exemplary embodiments of the present disclosure may be altered in a variety of ways. For example, and as shown in FIG. 7, the screen 85 is a mesh screen such as, for example, a woven mesh screen. However, any type of mesh screen may be used. In one or more embodiments, the entry points 91 are defined by voids in the mesh and are configured to prevent debris from entering the interior flow passage 78. In one or more embodiments, the shroud 92 is a hardenable or settable fluid that fills the entry points 91 in the screen 85. Thus, rather than overlaying screen 85, the shroud 92 is molded onto or into the screen 85 to fill the entry points 91. In one or more embodiments, the shroud 92 coats the exterior and/or interior of the screen 85. In one or more embodiments, the shroud 92 fills the entry points 91 in the screen 85 to prevent the fluid 76 from entering the passage 88 via the entry points 91 in the screen 85. Accordingly, erosion of the initially covered portion of the screen 85 is resisted or prevented. Once the shroud 92 erodes to expose a section of the initially covered portion of the screen 85, the erosion hotspot 114 moves to a section of the screen that was covered by the shroud 92. This results in a dynamic erosion hotspot 114, which reduces or slows the erosion of any one area on the screen 85. In one or more embodiments, the shroud 92 is composed of a polymer, such as for example, polyethylene, poly tetrafluoro-ethylene, polypropylene, polyisobutylene, polystyrene, polyacrylonitrile, poly vinyl chloride, poly methyl acrylate, poly methyl methacrylate, polybutadiene, polychloroprene, and polyisoprene. In one or more embodiments, the screen 85 is formed of a metal and the shroud 92 is formed of a polymer.

In one or more embodiments, the ICD 87 is any one of the EQUIFLOW® Inflow Control Devices by Halliburton Energy Services, Inc. In one or more embodiments, the fluid 76 includes any type of gas that flows from the formation 14.

In an alternate exemplary embodiment, it is not necessary for the wellbore 38 to be cased, cemented or horizontal as depicted in FIG. 1. It is also not necessary for the fluid 76 to flow from the formation 14 to the interior flow passage 78, since in injection, conformance, or other operations, fluid can flow in an opposite direction. It is not necessary for the fluid 76 to flow through the screen 85, or for the fluid to flow through the screen 85 prior to flowing through the flow regulating system 48. Thus, in one or more embodiments, the screen 85 and the shroud 92 may be incorporated in drilling or production equipment disposed anywhere along a flowpath between the formation 14 and a drilling or production platform.

In an exemplary embodiment, "erosion" of the shroud 92 encompasses any type of damage to the shroud 92 due to the flow of the fluid 76 and any accompanying debris across the shroud 92. This includes damage to the shroud 92 due to corrosion.

In an alternate exemplary embodiment, the shroud 92 and the screen 85 are composed of the same material but the dimensions of the shroud 92, relative to the dimensions of the screen 85, cause the shroud 92 to erode (the shroud length 108 is shortened) more quickly than erosion of the screen 85 at the same point. That is, the shroud 92 and the screen 85 could be composed of the same type of metal. In or more embodiments, for example, the thickness of the shroud 92, in comparison to a thickness of the wire 86 of the screen 85, may be selected so that the shroud 92 reaches a degree of erosion more quickly that the adjacent screen 85.

Thus, a screen assembly for a production tool has been described. Embodiments of the screen assembly may generally include an elongated tubular member with an opening defined in the exterior of the tubular member; an elongated screen having a plurality of openings disposed adjacent the exterior of the tubular member; a shroud disposed in proximity to the screen to define an initially covered portion of the screen; and a flow passage in fluid communication with the plurality of openings and the opening of the tubular member. Likewise, a completion system for a wellbore has been described. Embodiments of the completion system may generally include a screen assembly that includes a base pipe having an exterior surface; a screen having a plurality of openings with the screen concentrically disposed about the exterior surface of the base pipe; and a shroud covering an initial portion of the screen. Any of the foregoing embodiments may include any one of the following elements, alone or in combination with each other:

The opening of the tubular member being in fluid communication with an interior flow path defined within the tubular member.

The shroud has a shroud distal end spaced apart from the opening of the tubular member.

A flow passage is formed between the exterior of the tubular member and the screen.

The shroud comprises a tubular member that is concentrically disposed about an exterior surface of the screen to impede fluid flow through a portion of the plurality of openings within the screen.

The shroud comprises a material disposed within the openings within the initially covered portion of the screen. In one aspect, the material is an injected polymer.

The shroud distal end defines a shroud length along the longitudinal axis of the screen. In one aspect, the shroud distal end erodes to reduce the shroud length to expose the initially covered portion of the screen.

The screen is comprised of a material having a first rate of erosion under a set of conditions; the shroud is comprised of a material having a second rate of erosion under the set of conditions; and the second rate of erosion is higher than the first rate of erosion.

The screen is a wire-wrapped screen and the shroud comprises a tubular member that is concentrically disposed about an exterior surface of the wire-wrapped screen.

The screen is a mesh screen and the material of the shroud is disposed within the plurality of openings of the initial portion of the screen. In one aspect, the material is an injected polymer.

A flow passage is formed between the exterior surface of the base pipe and the shroud.

An inflow control device is disposed adjacent the screen assembly.

Thus, a method for controlling flow in a wellbore system has been described. Embodiments of the method generally include providing a screen having a plurality of openings and disposed about an exterior surface of a pipe to receive a fluid from a downhole formation through the openings; providing a shroud disposed in proximity to the screen to inhibit flow through a portion of the openings; causing fluid to flow through a plurality of openings adjacent the shroud distal end to erode the shroud distal end, thereby reducing the shroud first length to a shroud second length.

For any of the foregoing embodiments, the method may include any one of the following limitations, alone or in combination with each other:

Creating a high velocity fluid entry area at a first location on the screen that is adjacent a shroud distal end.

Moving the high velocity fluid entry area to a second location on the screen that is adjacent the eroded shroud distal end.

Moving the high velocity entry fluid entry area to the second location to reduce a rate of erosion of the screen at the first location on the screen.

Monitoring the erosion of the screen adjacent the shroud distal end.

Altering the flow rate of the fluid to expedite erosion of the shroud when the erosion of the screen adjacent the shroud distal end reaches a predetermined threshold.

Positioning the shroud distal end at a location removed from openings in a base pipe around which the screen is disposed so as to form a flow passage between the openings of the screen and the openings of the base pipe.

The screen is comprised of a material having a first rate of erosion under a set of conditions; the shroud is comprised of a material having a second rate of erosion under the set of conditions; and the second rate of erosion is higher than the first rate of erosion.

Determining the first length, wherein the first length is based on a length of the screen.

Moving the high velocity fluid entry area to the second location on the screen delays erosion of the screen at the first location.

Coupling the screen to an inflow control device.

The foregoing description and figures are not drawn to scale, but rather are illustrated to describe various embodiments of the present disclosure in simplistic form. Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Accordingly, the intention is to cover all modifications, equivalents and alternatives falling within the spirit and scope of the disclosure as defined by the appended claims.

What is claimed is:

1. A screen assembly for a production tool, comprising:

an elongated tubular member with an opening defined in the exterior of the tubular member, the opening being in fluid communication with an interior flow path defined within the tubular member;

an elongated screen having a plurality of openings disposed adjacent the exterior of the tubular member;

a shroud disposed in proximity to the screen to define an initially covered portion of the screen, the shroud having a shroud distal end spaced apart from the opening of the tubular member; and a flow passage in fluid communication with the plurality of openings of the screen, the flow passage formed between the exterior of the tubular member and the screen; wherein the screen is comprised of a material having a first rate of erosion under a set of conditions;

the shroud is comprised of a material having a second rate of erosion under the set of conditions; and the second rate of erosion is higher than the first rate of erosion.

2. The assembly as defined in claim 1, wherein the shroud comprises a tubular member that is concentrically disposed about an exterior surface of the screen to impede fluid flow through a portion of the plurality of openings within the screen.

3. The assembly as defined in claim 1, wherein the shroud comprises a material disposed within the openings within the initially covered portion of the screen.

4. The assembly as defined in claim 3, wherein the material is an injected polymer.

5. The assembly as defined in claim 1, wherein the shroud distal end defines a shroud length along the longitudinal axis of the screen; and the shroud distal end erodes to reduce the shroud length to expose the initially covered portion of the screen.

6. The assembly as defined in claim 1, further comprising an inflow control device disposed adjacent the screen assembly; and an erosion sensor;

wherein the erosion sensor is configured to monitor erosion of the screen adjacent a shroud distal end; and wherein the inflow control device is configured to alter a flow rate of a fluid to expedite erosion of the shroud when the erosion of the screen adjacent the shroud distal end reaches a predetermined threshold.

7. A completion system for a wellbore, comprising:

a screen assembly comprising:

a base pipe having an exterior surface;

a screen having a plurality of openings, the screen concentrically disposed about the exterior surface of the base pipe;

and a shroud covering an initial portion of the screen;

wherein the screen is comprised of a material having a first rate of erosion under a set of conditions;

wherein the shroud is comprised of a material having a second rate of erosion under the set of conditions; and wherein the second rate of erosion is higher than the first rate of erosion.

8. The completion system as defined in claim 7, wherein the screen is a wire-wrapped screen and the shroud comprises a tubular member that is concentrically disposed about an exterior surface of the wire-wrapped screen.

9. The completion system as defined in claim 7, wherein the screen is a mesh screen and the material of the shroud is disposed within the plurality of openings of the initial portion of the screen.

10. The completion system as defined in claim 9, wherein the material is an injected polymer.

11. The completion system as defined in claim 7, further comprising a flow passage formed between the exterior surface of the base pipe and the screen.

12. The completion system as defined in claim 7, further comprising an inflow control device disposed adjacent the screen assembly.

13. The completion system as defined in claim 7, further comprising an inflow control device disposed adjacent the screen assembly; and an erosion sensor;

wherein the erosion sensor is configured to monitor erosion of the screen adjacent a shroud distal end;

wherein the inflow control device is configured to alter a flow rate of a fluid to expedite erosion of the shroud when the erosion of the screen adjacent the shroud distal end reaches a predetermined threshold.

14. A method for controlling flow in a wellbore system, the method comprising:

providing a screen having a plurality of openings and disposed about an exterior surface of a pipe to receive a fluid from a downhole formation through the openings;

providing a shroud disposed in proximity to the screen to inhibit flow through a portion of the openings, thereby creating a high velocity fluid entry area at a first location on the screen that is adjacent a shroud distal end, the shroud distal end defining a first length of the shroud; and causing fluid to flow through a plurality of openings adjacent the shroud distal end to erode the shroud distal end, thereby reducing the first length of the shroud to a second length of the shroud and thereby moving the high velocity fluid entry area to a second location on the screen that is adjacent the eroded shroud distal end;

wherein moving the high velocity entry fluid entry area to the second location reduces a rate of erosion of the screen at the first location on the screen:

wherein the screen is comprised of a material having a first rate of erosion under a set of conditions;

wherein the shroud is comprised of a material having a second rate of erosion under the set of conditions; and wherein the second rate of erosion is higher than the first rate of erosion.

15. The method of claim 14, further comprising, monitoring the erosion of the screen adjacent the shroud distal end.

16. The method of claim 15, further comprising, altering the flow rate of the fluid to expedite erosion of the shroud when the erosion of the screen adjacent the shroud distal end reaches a predetermined threshold.

17. The method of claim 16, further comprising, positioning the shroud distal end at a location removed from openings in a base pipe around which the screen is disposed so as to form a flow passage between the openings of the screen and the openings of the base pipe.

18. The method of claim 14, further comprising determining the first length of the shroud, wherein the first length of the shroud is based on a length of the screen.

19. The method of claim 14, wherein moving the high velocity fluid entry area to the second location on the screen delays erosion of the screen at the first location.

20. The method of claim 14, further comprising coupling the screen to an inflow control device.

* * * * *